United States Patent [19]

Tajima

[11] 4,425,382

[45] Jan. 10, 1984

[54] DEVELOPER CARRIER

[75] Inventor: Syouji Tajima, HigashiKanamachi, Japan

[73] Assignee: Ricoh Company, Ltd., Tokyo, Japan

[21] Appl. No.: 437,450

[22] Filed: Oct. 28, 1982

[30] Foreign Application Priority Data

Oct. 28, 1981 [JP] Japan ..... 56-171503

[51] Int. Cl.[3] ..... B05D 1/36

[52] U.S. Cl. ..... 427/203; 427/205; 427/210; 355/3 DD; 430/122; 118/657; 118/658; 29/130; 29/132; 428/36

[58] Field of Search ..... 118/657, 658; 430/122; 29/130, 132; 427/203, 205, 410

[56] References Cited

U.S. PATENT DOCUMENTS

| | | | |
|---|---|---|---|
| 3,097,080 | 7/1963 | Weir | 427/203 |
| 3,863,603 | 2/1975 | Buckley et al. | 118/658 |
| 4,034,709 | 7/1977 | Fraser et al. | 118/658 |

FOREIGN PATENT DOCUMENTS

| | | | |
|---|---|---|---|
| 453157 | 9/1936 | United Kingdom | 427/203 |

*Primary Examiner*—Shrive P. Beck

*Attorney, Agent, or Firm*—Guy W. Shoup; Robert Scobey

[57] ABSTRACT

The present invention provides an improved method for manufacturing a developer carrier for use in a device for developing an electrostatic latent image, for example, formed on a photosensitive member. The present method allows to make a developer carrier which is durable and which can carry out ideal developing performance. In accordance with the present method, after forming a first adhesive layer on a support, conductive particles are deposited, followed by the step of forming a second adhesive layer to have the particles embedded therein. Then, the resulting structure is ground to have at least some of the particles exposed at the ground surface.

8 Claims, 17 Drawing Figures

DEVELOPER CARRIER

BACKGROUND OF THE INVENTION

1. Field of the Invention

This invention generally relates to a developing device for developing an electrostatic latent image formed on an image bearing member to convert the latent image into a visual image, and in particular, to a developer carrier forming a part of the developing device for carrying thereon a layer of developer to be applied to the latent image for its visualization. Specifically, the present invention relates to a method for manufacturing such a developer carrier.

2. Description of the Prior Art

A developing device including a developer carrier, on which a layer of developer including toner particles is formed, for applying the developer to an electrostatic latent image formed on an image bearing member comprised of a conductive support and a photoconductive layer formed on the support for visualizing the latent image has been widely used in electrophotographic copiers, electrostatic recording machines and various other types of machines. In the developing technology, electrostatic latent images may be categorized into two different classes depending upon the degree of their spatial frequencies. One of them includes "line images" which are mainly comprised of higher spatial frequency components, and the other class includes "area images" having lower frequency components. The line image is an image mainly formed by lines appropriately arranged to indicate a pattern or character; on the other hand, the area image implies an image having a relatively large two-dimensional sections to be developed such as a picture.

It is to be noted that required developing conditions differ depending upon the class of image, i.e., whether it is a line image or area image. Stated more in detail, in the case of area images, it is normally required that the developing density vary depending upon the level of the surface potential of an electrostatic latent image to be developed so as to express tone or shading variation. On the other hand, in the case of line images, the developing density is normally required to be always high irrespective of the level of the surface potential of a latent image to be developed. In other words, a line image is usually desired to be developed to a high density image even if the surface potential of its latent image is very low.

Such dual requirements in development are satisfied as long as use is made of a two component developer comprised of toner and carrier beads. However, in developing devices using a single component developer comprised of magnetic toner particles, difficulty has been experienced in satisfying the above-noted dual requirements. Under the circumstances, there has also been proposed an improved developing device using a single component developer which could satisfy the above-noted requirements as disclosed in the Japanese Patent Application No. 55-185726. The proposed developing device is characterized by using a novel developer carrier including a conductive support and a plurality of conductive particles provided on the support such that the particles are electrically isolated from one another as well as from the support thereby the conductive particles function as floating fine electrodes. With such a structure, the above-noted dual requirements may be satisfied sufficiently.

Several methods for manufacturing a developer carrier having the above-described structure have also been proposed as will be briefly reviewed below.

(a) Conductive particles of metal are first mixed with a dielectric resin material and such a mixture is then deposited on a conductive support.

(b) An adhesive agent is first applied to a conductive support and then conductive particles are spread thereon.

(c) A dielectric layer is first formed on a conductive support and then a conductive layer is formed on the dielectric layer. Then the conductive layer is converted into a pattern of islands each forming a fine electrode, for example, by etching.

However, in accordance with the above-described method (a), as the mixture ratio of the particles increases as compared with the resin, it becomes increasingly difficult to form a layer of the mixture on the support. Thus, the mixture ratio is rather limited. The above-described method (b) also suffers from disadvantages because the resulting surface is significantly irregular and thus it is impossible to form a developer layer of uniform thickness. Besides, the particles are rather prone to come off, indicating a poor servicelife. The prior art method (c) tends to be expensive thereby necessarily increasing manufacturing cost.

SUMMARY OF THE INVENTION

The disadvantages of the prior art are obviated by the present invention and an improved method for manufacturing a developer carrier which is used for applying developer to an electrostatic latent image is provided.

In accordance with one aspect of the present invention, there is provided a method for manufacturing a developer carrier for use in a device for developing an electrostatic latent image, said method comprising the steps of (a) forming a first layer of a first adhesive and substantially insulating material on the surface of a conductive support; (b) depositing particles of an electrically conductive material on the surface of said first layer before said first material is hardened substantially; (c) forming a second layer of a second adhesive and substantially insulating material on the particle-deposited surface of said first layer; and (d) grinding the thus formed structure to have at least some of said particles ground to be exposed at the resulting surface.

In this manner, in accordance with the present invention, deposition of conductive particles is carried out after formation of an adhesive layer on a support, and then an additional adhesive layer is formed on the particle-deposited first adhesive layer so that the conductive particles become completely embedded. Then the resulting structure is ground to remove at least part of the additional adhesive layer and at least part of some of the embedded particles to present a smooth surface for carrying thereon developer. As a result, the particles which will function as floating electrodes are firmly held in the adhesive layer, which indicates a prolonged servicelife and reliability in operation.

Therefore, it is a primary object of the present invention to provide a novel method for manufacturing a developer carrier for use in a device for developing an electrostatic latent image.

Another object of the present invention is to provide a method for manufacturing a developer carrier which is provided with a plurality of floating electrodes at its surface with at least some of them exposed at the surface.

A further object of the present invention is to provide a method for manufacturing a developer carrier which may be carried out relatively easily.

A still further object of the present invention is to provide a method for manufacturing a developer carrier having a smooth surface on which a uniform layer of developer may be formed without difficulty.

Other objects, advantages and novel features of the present invention will become apparent from the following detailed description of the invention when considered in conjunction with the accompanying drawings.

DESCRIPTION OF THE PREFERRED EMBODIMENTS

Figure 1A:
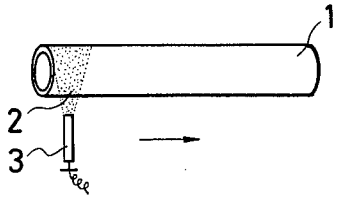
FIGS. 1*a* through 1*d* are schematic illustrations showing the steps of one embodiment of the present method for manufacturing a developer carrier including a plurality of fine floating electrodes.

Referring now to the drawings, a detailed description as to preferred embodiments of the present invention will follow.

As shown in FIG. 1*a*, a conductive support 1 is prepared. In this embodiment, the support 1 is comprised of a cylinder, but the present invention should not be limited to such a particular shape and the support 1 may take any other appropriate shape such as a plate. If a developing device in which the present developer carrier is to be installed uses magnetic toner, the developer carrier must be of non-magnetic nature, and therefore, in this case, the support 1 to be prepared must be comprised of a non-magnetic material such as aluminum and stainless steel.

Figure 2A:
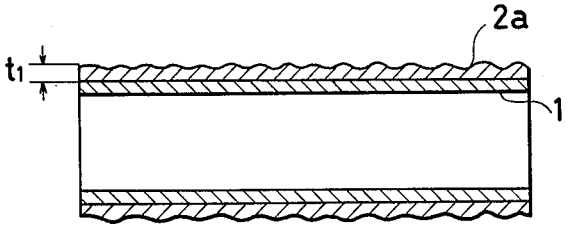
FIGS. 2*a* through 2*e* are cross-sectional views showing how the structure varies when the present method shown in FIGS. 1*a* through 1*d* is carried out.
Figure 2B:
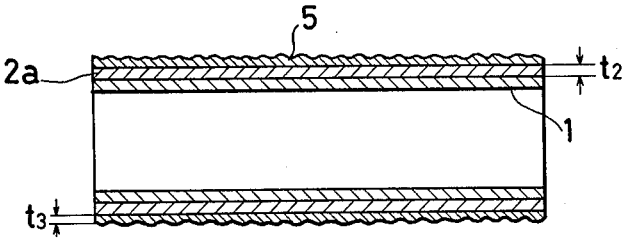

Then, the outer peripheral surface of the cylinder support 1 is subjected to any well known oil-removing treatment. Thereafter, dielectric powder 2 is sprayed onto the peripheral surface of the cylinder support 1, for example, by means of an electrostatic spray painting machine 3 as shown in FIG. 1*a*. The powder 2 may include thermoplastic resin powder such as epoxy resin powder. The sprayed powder is then hardened by heating to form a dielectric layer 2*a* having the thickness $t_1$ of, for example, approximately 500 microns across the peripheral surface of the cylinder support 1 as shown in FIG. 2*a*. Since the outer surface of the thus formed dielectric layer 2*a* is usually irregular, the outer surface is ground to eliminate irregularities thereby presenting a smooth surface. After grinding, the dielectric layer 2*a* has the thickness $t_2$ of, for example, approximately 300 microns, as shown in FIG. 2*b*. Thus, the dielectric layer 2*a* defines an underlying layer on which a layer including a plurality of floating fine electrodes is to be formed.

Figure 1B:
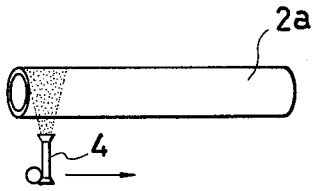
Figure 1C:
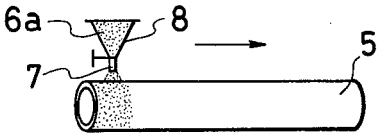

After grinding the dielectric layer 2*a* to a desired thickness, the outer ground surface is cleaned, and then an insulating adhesive material is sprayed onto the outer surface of the dielectric layer 2*a*, for example, by means of a pressurized air spray 4, as shown in FIG. 1*b*. As a result, as shown in FIG. 2*b*, the first adhesive layer 5 is formed overlying the dielectric layer 2*a*. The thickness of the layer 5 is typically 50 microns. The insulating adhesive material to be sprayed inclues a two-part adhesive material, which hardens at normal temperatures, such as a liquid epoxy resin.

Figure 2C:
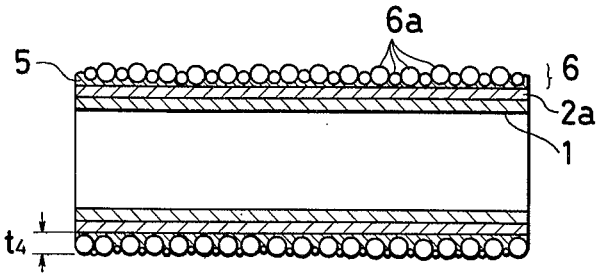

After application of the first adhesive material as described above and before it hardens substantially, conductive fine particles of, for example, metal are deposited on the first adhesive layer to form a layer 6 of conductive particles 6*a*, as shown in FIG. 2*c*. In order to have the conductive fine particles 6*a* deposited, use may be made of a hopper 8 contained therein a quantity of conductive fine particles 6*a*. The hopper 8 is provided with a supply port 7 at its bottom, which may be appropriately opened or closed to regulate the flow rate of the particles 6*a* to be discharged. Thus the particles 6*a* are caused to fall onto the first adhesive layer 2*a* formed on the cylinder support 1 as it rotates. It is to be noted that the conductive particles 6*a* are preferably coated with an insulating material. When use is made of such coated particles 6*a*, it is insured that the particles 6*a* are well electrically isolated from one another as well as from the conductive support 1 thereby allowing them to properly function as floating electrodes. As shown in FIG. 2*c*, preferably, the combined thickness $t_4$ between the first adhesive layer 5 and the particle layer 6 is approximately 100 microns.

As discussed above, it is rather important that conductive fine particles 6*a* be electrically isolated from one another in order to attain intended objectives. In this respect, it is preferable that the particles 6*a* are individually coated with a resin material having the volume resistivity of $10^{12}$ ohms-cm or more and the thickness ranging from 0.5 microns to 0.5 mm, preferably 0.5 microns to 0.1 mm. The diameter of the particles 6*a* may range between 10 and 500 microns, and the average diameter is preferred to be in the neighborhood of 100 microns.

As one example, aluminum particles were sieved to obtain classified particles having the diameter ranging between 70 and 80 microns. Then the classified particles were mixed into a solution containing an epoxy resin having the volume resistivity of $10^{14}$ ohms-cm. Such a mixture was then churned for approximately one hour in a ball mill to have the conductive particles of aluminum well dispersed in the molten resin. Thereafter, the mixture was sprayed and at the same time dried by means of a spray dryer to obtain epoxy-resin-coated conductive particles of aluminum. Such coating was found to be approximately 3 microns thick.

As another example of coated conductive particles, use was made of iron particles which had been sieved to have the size in the range between 40–50 microns. Then a solvent containing molten acrylic resin having the volume resistivity of $10^{15}$ ohms-cm was sprayed onto the iron particles and the sprayed solvent was allowed to dry so that the acrylic resin coating of approximately 1 micron thickness was formed on each of the iron particles.

Figure 2D:
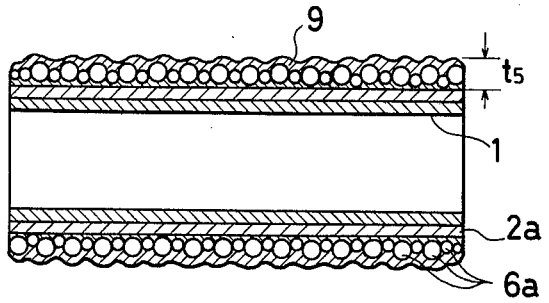

After depositing the conductive particles 6*a*, an insulating adhesive material is additionally sprayed to form a second layer 9 of a second insulating adhesive material, as shown in FIG. 2*d*. The formation of the second adhesive layer 9 may be effected in the same manner as in the case of forming the first adhesive layer 5 as described previously in connection with FIG. 1*b*. Besides, the second adhesive material is preferably the same as the first adhesive material, because adhesiveness of the particles 6*a* may be enhanced. Typically, the combined thickness $t_5$ of the overlying structure including the first adhesive layer 5, particle layer 6 and second adhesive layer 9 is approximately 150 microns.

Figure 2E:
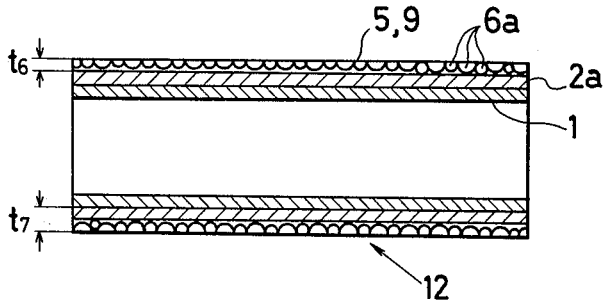

Upon formation of the second adhesive layer 9, it is allowed to harden completely, and then the resulting structure is ground to make its outer surface smooth and at the same time have at least some of the embedded conductive particles 6*a* exposed at the ground surface, as shown in FIG. 2*e*. Since the grinding is carried out from the outer peripheral surface, the embedded particles 6*a* are also ground partly when exposed at the outer surface so that the finished surface provides an extremely smooth surface without irregularities. This allows to make a developer layer having a remarkably uniform thickness on the present developer carrier and therefore developing performance may be improved.

Figure 1D:
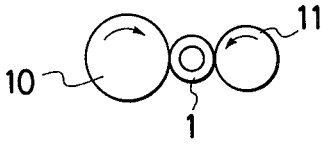

FIG. 1*d* shows the grinding step of the present method for manufacturing a developer carrier. As shown schematically, the grinding machine includes a first grinding wheel 10 which is driven to rotate clockwise and a second grinding wheel 11 which is driven to rotate counter-clockwise and spaced apart from the first grinding wheel 10. The structure shown in FIG. 2*d* is positioned inbetween the first and second grinding wheels 10, 11 to have its outer surface ground to cause at least some of the embedded particles 6*a* to be exposed. The grinding machine shown in FIG. 1*d* is a so-called centerless grinder, but it is to be noted that any other appropriate grinding method may be equally used.

Figure 2F:
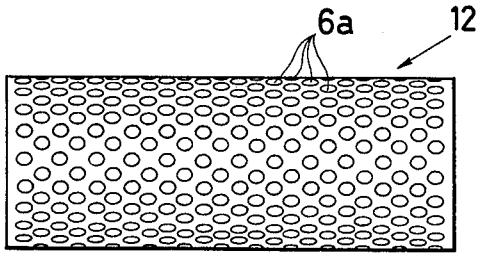
FIG. 2*f* is a front view showing the developer carrier manufactured in accordance with the present method.

Upon completion of grinding, the resulting structure is cleaned to remove abrasives and ground debries, followed by checking of the outer diameter of the resulting structure, if necessary. In this manner, manufacture of the present developer carrier 12 is completed, and the finished product as a result of the present manufacturing process is shown in FIG. 2*f*. When completed, the combined thickness $t_6$ including the first adhesive layer 5, particle layer 6 and second adhesive layer 9 is approximately 100 microns.

Figure 1E:
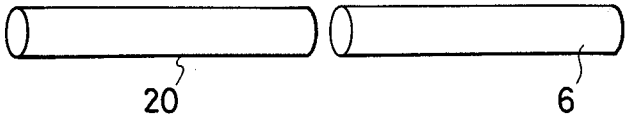
FIG. 1*e* is a schematic illustration showing an additional step to be employed in another embodiment of the present method for manufacturing a developer carrier including a plurality of fine floating electrodes.
Figure 2G:
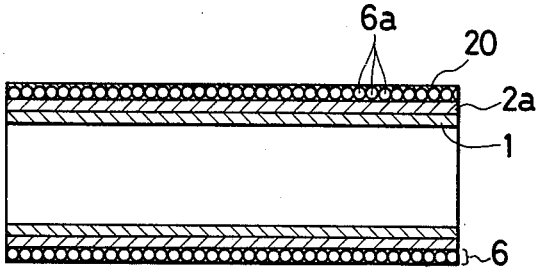
FIG. 2*g* is a cross-sectional view showing the structure after the step of FIG. 1*e* has been carried out.

As an alternative method, an additional step of pressing the deposited particles 6*a* into the first adhesive layer 5 before it hardens may be carried out prior to the formation of the second adhesive layer 9. That is, as shown in FIG. 1*e*, having deposited the particles 6*a* on the first adhesive layer 5, a thermally shrinkable tube 20 may be fitted onto the cylinder support. When the tube 20 is heated, it shrinks to push the deposited particles 6*a* into the first adhesive layer 5 so that possible aggregates of particles 6*a* may be broken into individual particles and also the particles 6*a* become uniformly distributed across the peripheral surface. Preferably, the particles 6*a* are forced to be arranged to define a cylinder having the wall thickness equal to the diameter of the particles as shown in FIG. 2*g*. A polyester tube having the wall thickness of 50 microns may be used for this purpose, though it is not intended to limit to this particular example.

As described above, in accordance with the present invention, the conductive particles 6*a* to be used as floating electrodes as exposed at the surface are first embedded between the first and second adhesive layers 5, 9 so that they firmly cling to the structure even if they are partly exposed at the surface after the grinding step. Thus none of the exposed particles will be lost during operation. Moreover, since application of an adhesive material and deposition of conductive particles take place separately, formation of clumps or aggregates of particles may be advantageously avoided and the particles may be uniformly distributed across the entire surface. Besides, since the combined adhesive layer together with at least some of the embedded particles are ground from outside, the resulting surface is insured to be smooth and free of irregularities. Therefore, it is now possible to form a developer layer of uniform and desired thickness on the surface of the present developer carrier when used in a developing device. As will be described in detail later, the exposed conductive particles will function as floating electrodes to help increase image density when a line image of relatively lower surface potential is to be developed by a single component developer, e.g., magnetic toner.

In the above description, the underlying dielectric layer 2*a* is formed on the cylinder support 1; however, this layer may be discarded as long as the thickness $t_7$ defined by the combined layers formed on the support 1 when completed is in a desired range and the particles 6*a* are electrically isolated from the support 1 to a sufficient level.

Now, in what follows, it will be described as to the principle of the developing operation when the developer carrier manufactured as described above is employed in a device for developing an electrostatic latent image formed on a photosensitive member with particular reference to FIGS. 3*a* and 3*b*. As shown, the present developer carrier 12 is positioned as opposed to a photosensitive member 13 with a small gap therebetween. As is well known in the electrostatographic technology, the photosensitive member 13 includes a conductive base 14, which is usually connected to ground, and a photosensitive layer 15 formed on the base 14. On the other hand, the developer carrier 12 for applying developer, e.g., magnetic toner, to an electrostatic latent image formed on the member 13 has the same structure as shown in FIG. 2*e* wherein like numerals are used to indicate like elements as practiced throughout the present specification. It should be noted, however, that, in FIGS. 3*a* and 3*b*, the dielectric layer 2*a*, and first and second adhesive layers 5, 9 are illustrated as a single layer for the sake of clearity.

Figure 3A:
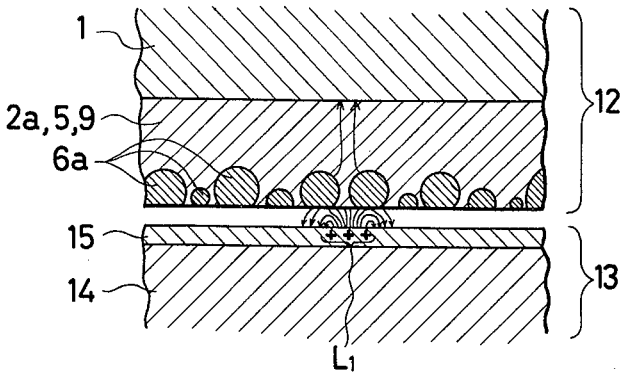
FIG. 3*a* is a schematic illustration when the present developer carrier is used for developing a line image.
Figure 3B:
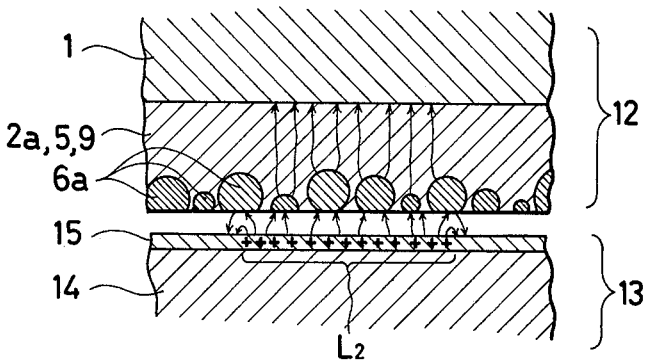
FIG. 3*b* is a schematic illustration when the present developer carrier is used for developing an area image.

It should also be noted that a layer of developer is, in fact, formed on the surface of the developer carrier 12 facing the photosensitive member 13, but such a developer layer is not shown in FIGS. 3*a* and 3*b*. The photoconductive layer 15 bears an electrostatic latent image $L_1$ in FIG. 3*a* or $L_2$ in FIG. 3*b* which is defined by electrostatic charges, positive in the illustrated example, having the polarity opposite to that of the developer. As may have been noticed, the latent image $L_1$ shown in FIG. 3*a* forms a line image; whereas, the latent image $L_2$ shown in FIG. 3*b* forms an area image. Accordingly, only difference existing between the structures shown in FIGS. 3*a* and 3*b* is the class of the latent image formed in the photosensitive layer 15.

As is well known, developer/toner, which is not shown but carried on the developer carrier 12, is in part electrostatically attracted to the charges existing in the photoconductive layer 15 to define the latent image $L_1$ or $L_2$ and thus the latent image is developed to become a visualized image. In this instance, the amount of developer/toner attracted to the latent image $L_1$ or $L_2$ predominantly depends upon the intensity of the electric field in the neighborhood of the surface of the photoconductive layer 15. That is, the larger the electric field is, the larger the amount of the developer attracted to the latent image $L_1$ or $L_2$ thereby increasing the image density of the developed image.

In the case of a line image as shown in FIG. 3*a*, electric field lines emanating from the latent image $L_1$ are mostly directed toward the background of the photoconductive layer 15 where no image is formed, and only some of the field lines are directed to the conductive support 1 of the developer carrier 12. This is due to the fact that a number of fine conductive particles 6*a* which are electrically isolated from one another and also from the conductive support 1 are present in the vicinity of the photoconductive layer 15 even though the conductive support 1 which functions as an opposite electrode to the photosensitive member 13 is present. In other words, presence of the conductive particles 6*a* tends to increase the number of field lines which are directed to the background from the latent image $L_1$ as compared with the case where no conductive particles 6*a* are present. Stated differently, presence of the conductive particles 6*a* contributes to make the dielectric thickness between the latent image $L_1$ and the background smaller as compared with the case where no conductive particles 6*a* are present. The above described phenomenon of increasing the field strength along the boundary between the latent image $L_1$ and the surrounding background is commonly referred to as the "edge effect" and presence of the conductive particles 6*a* in effect enhances this edge effect. For this reason, since the conductive particles 6*a* are present in the vicinity of the latent image $L_1$, the field strength around the latent image $L_1$ is significantly increased, which, in turn, attracts more developer/toner thereby allowing to form a developed image of increased image density as compared with the case where particles 6*a* are absent.

In the case of the latent image $L_2$ defining an area image as shown in FIG. 3*b*, almost all of the field lines emanating from the internal portion of the latent image $L_2$ excepting those from its boundary are directed to the opposite electrode of the conductive support 1. This is because, in this case, the dielectric thickness between the internal portion of the latent image $L_2$ and the background of the photoconductive layer 15 is larger than the dielectric thickness between the internal portion of the latent image $L_2$ and the support 1. This phenomenon prevails irrespective of presence or absence of the conductive particles 6*a* so that the field strength in the vicinity of the internal portion of the latent image $L_2$ is little affected by presence of the conductive particles 6*a* in the case of an area image.

Figure 4:
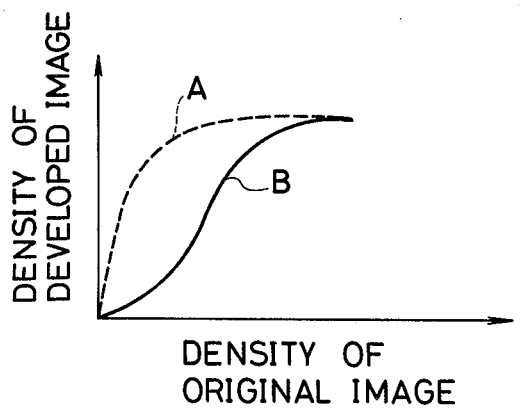
FIG. 4 is a graph showing an ideal relation between the density of an original image and the density of a developed image for a line image as well as for an area image.

As is apparent from the above description, presence of the conductive particles 6*a* has the advantage of increasing the developing efficiency only in the case of line images. Such a characteristic is schematically illustrated in FIG. 4 in which the abscissa indicates the density of an original image to be developed and the ordinate indicates the density of a developed image. As shown, the dotted line A shows a characteristic for line images and the solid line shows a characteristic for area images. When the two characteristics are compared, it is obvious that the dotted line A has a significantly steeper slope, indicating that line images are developed with higher developing efficiencies as compared with area images if use is made of the developer carrier manufactured in accordance with the present invention. In the case of line images, it is almost always desirous to develop them with increased image density irrespective of the condition of original images, and thus the characteristics shown in FIG. 4 may be said to indicate ideal developing characteristics.

Figure 5:
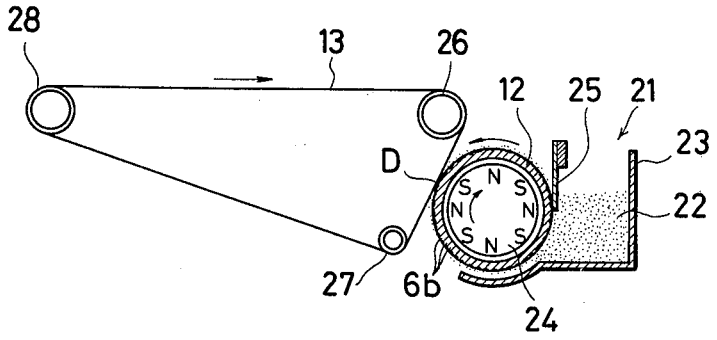
FIG. 5 is a schematic illustration showing when the present carrier is used as means for applying a quantity of developer under control to an electrostatic latent image formed on a photosensitive belt in a contact developing mode.

FIG. 5 schematically shows the structure of an electrophotographic copying machine including a developing device 21 in which the developer carrier 12 manufactured in accordance with the present invention is incorporated. The developing device 21 includes a tank 23 containing therein a quantity of single component developer 22 such as high resistivity magnetic toner. The volume resistivity of such toner should be $10^{10}$ ohms-cm or more. The developer carrier 12 is in the form of a sleeve having a number of floating electrodes 6*b* partly exposed at the outer peripheral surface. The sleeve-shaped developer carrier 12 is rotatably journaled to the machine housing (not shown) and it is driven to rotate in the direction indicated by the arrow. Inside the carrier 12 is provided a magnet roller 24 having opposite polarities arranged alternately along its periperal surface. The magnet roller 24 is also supported rotatably and it is driven to rotate in the direction opposite to the developer carrier 12.

In operation, as the developer carrier 12 rotates, the magnetic toner 22 in the tank 23 are partly attracted to the carrier 12 to be carried thereon. Then a blade 25 controls the amount of toner carrier by the carrier 12 as riding thereon. The blade 25 is made from a magnetic resilient plate and thus it is lightly pressed against the peripheral surface of the carrier 12 due to the magnetic roller 24. Accordingly, the blade 25 controls the thickness of a developer layer to be formed on the carrier 12 for application to an electrostatic latent image at a developing region D. As described previously, since the floating electrodes 6*b* are firmly fixed to the carrier 12, they will not be lost even if the blade 25 is in scrubbing contact with the peripheral surface of the carrier 12 thereby allowing to maintain a desired developing performance for an extended period of time.

As the developer carrier 12 rotates, the developer layer thus formed on the carrier 12 is moved to the developing region D. It is to be noted that the toner particles forming the developer layer are charged to a predetermined polarity. On the other hand, a photosensitive belt 13 is extended around rollers 26, 27 and 28, and it is driven to travel in the direction indicated by the arrow. On the surface of the belt 13 is formed an electrostatic latent image by means of any well known device (not shown). The latent image is moved to the developing station D as the belt 13 advances, where the latent image becomes developed by attracting toner particles from the developer layer formed on the carrier 12. In the structure shown in FIG. 5, the belt 13 is in pressure contact with the developer carrier 12 in order to effect contact developing. It will now be easily appreciated that the developer carrier 12 manufactured in accordance with the present invention may be advantageously employed for contact developing because of increased adherence of floating electrodes to the carrier body. The developed image on the belt 13 will then be transferred to a transfer medium as is well known for those skilled in the art. On the other hand, the toner remaining on the developer carrier 12 after development will be returned to the tank for reuse.

Figure 6:
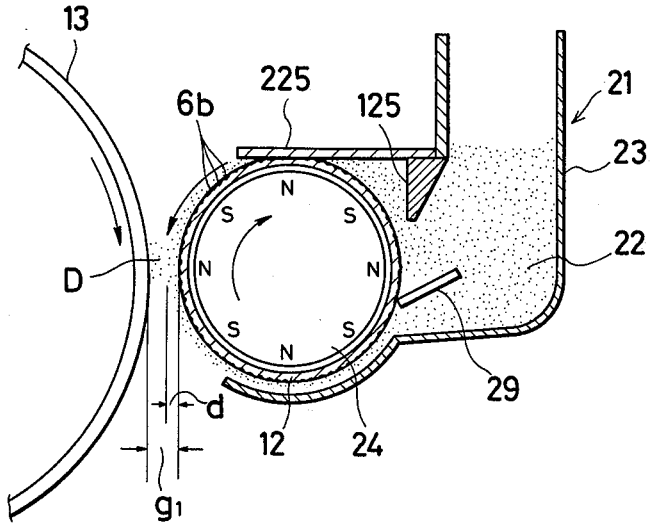
FIG. 6 is a schematic illustration showing when the present developer carrier is used as means for applying a regulated amount of developer to an electrostatic latent image formed on a photosensitive drum.

FIG. 6 shows a part of the structure of another electrophotographic copying machine to which the developer carrier 12 manufactured in accordance with the present invention is applied. As shown, the photosensitive member 13 is in the shape of a drum in this case, and the layer thickness control device includes a doctor blade 125 of a rigid body for roughly controlling the thickness of a toner layer and an auxiliary blade 225 for controlling the thickness of the toner layer to be uniform prior to application for development of a latent image. Provision is also made of a scraper 29 for scraping the remaining toner off the developer carrier 12 to be securely returned to the tank 23. In this case, the gap $g_1$ between the photosensitive drum 13 and the developer carrier 12 is relatively large and it is approximately 100 microns. On the other hand, the toner layer formed on the peripheral surface of the developer carrier 12 has the thickness d ranging from 20 to 30 microns. Accordingly, with the structure shown in FIG. 6, non-contact type developing takes place, and the present developer carrier 12 may be used equally advantageously.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A method for manufacturing a developer carrier for use in a device for developing an electrostatic latent image, said method comprising the steps of:

(a) forming a first layer of a first adhesive and substantially insulating material on the surface of a conductive support;

(b) depositing particles of an electrically conductive material on the surface of said first layer before said first material is hardened substantially;

(c) forming a second layer of a second adhesive and substantially insulating material on the particle-deposited surface of said first layer; and (d) grinding the thus formed structure to have at least some of said particles ground to be exposed at the resulting surface.

2. A method as in claim 1 wherein said first and second adhesive and substantially insulating materials are the same material.

3. A method as in claim 2 wherein said adhesive and substantially insulating material includes an epoxy resin.

4. A method as in claim 1 wherein said support is comprised of a non-magnetic material including aluminum and stainless steel.

5. A method as in claim 1 or 4 wherein said support is in the shape of a cylinder.

6. A method as in claim 1 further comprising the step of forming an underlying layer of a dielectric material on the surface of said conductive support prior to the step of (a) so that said first layer is formed on said underlying layer.

7. A method as in claim 1 wherein said particles are previously coated with an insulating material.

8. A method as in claim 1 further comprising the step of pressing the deposited particles into said first layer prior to the step (c).

* * * * *